US011084185B2

(12) United States Patent
Maier

(10) Patent No.: US 11,084,185 B2
(45) Date of Patent: Aug. 10, 2021

(54) APPARATUS FOR FORMING SCORES IN A PLURALITY OF CURB SECTIONS OR A MASONRY STRUCTURE

(71) Applicant: Eric Maier, Houston, TX (US)

(72) Inventor: Eric Maier, Houston, TX (US)

( * ) Notice: Subject to any disclaimer, the term of this patent is extended or adjusted under 35 U.S.C. 154(b) by 0 days.

(21) Appl. No.: 16/360,568

(22) Filed: Mar. 21, 2019

(65) Prior Publication Data

US 2020/0298447 A1 Sep. 24, 2020

(51) Int. Cl.
*B28D 1/04* (2006.01)
*B28D 7/02* (2006.01)

(52) U.S. Cl.
CPC ..... *B28D 1/045* (2013.01); *B28D 1/048* (2013.01); *B28D 7/02* (2013.01)

(58) Field of Classification Search
CPC ..... B24B 7/22; B24B 7/222; B24B 7/224; B24B 7/226; B24B 7/228; B28D 1/003; B28D 1/225; B28D 1/226; B28D 1/228; B28D 7/04; B28D 7/005; B28D 1/02; B28D 1/025; B28D 1/04; B28D 1/041; B28D 1/042; B28D 1/043; B28D 1/044; B28D 1/045; B28D 1/046; B28D 1/047; B28D 1/048; C03B 33/12
USPC ..... 83/471, 477, 477.1, 483, 486, 676; 451/353; 125/13.01–13.03, 20
See application file for complete search history.

(56) References Cited

U.S. PATENT DOCUMENTS 3,935,777 A * 2/1976 Bassett ..... B23D 59/002 83/471.3
3,974,565 A * 8/1976 Ellis ..... B23D 45/14 30/376
5,205,197 A * 4/1993 Wiltshire ..... B28D 1/046 83/364
5,676,125 A * 10/1997 Kelly ..... B28D 1/045 125/13.03
7,373,936 B1 * 5/2008 Zagorouiko ..... B23Q 9/005 125/38
8,162,726 B1 * 4/2012 Jorgensen ..... B24B 23/028 451/344
8,671,811 B2 * 3/2014 Rybka ..... B23D 47/02 83/477.1
2018/0207838 A1 * 7/2018 Tolzman ..... B24B 9/00

* cited by examiner

*Primary Examiner* — William V Gilbert

(57) ABSTRACT

An apparatus for forming horizontal and linear score at a predefined depth or adjustable depth in a plurality of curb sections or a similar concrete or masonry structure. The apparatus comprises a frame, two-axis of linear bearings guides, angle grinder, cutting blades, and protective shield. The frame is secured in the curb section or structure through stakes to penetrate a ground or slip into holes of a horizontal surface. The frame includes a plurality of first adjustment units to allow adjustments for heights according to the height of curb section, and second adjustment units to allow adjustments for depths according to the depth of the curb section. A horizontal linear bearing guide rides up and down on a vertical linear bearing guide and restricted by a height adjustment mechanism. The angle grinder hanged on a mount attached to the linear bearing. The protective shield covers the plurality of cutting blades and further attached to a water supply to provide a spray on the plurality of cutting blades.

4 Claims, 1 Drawing Sheet

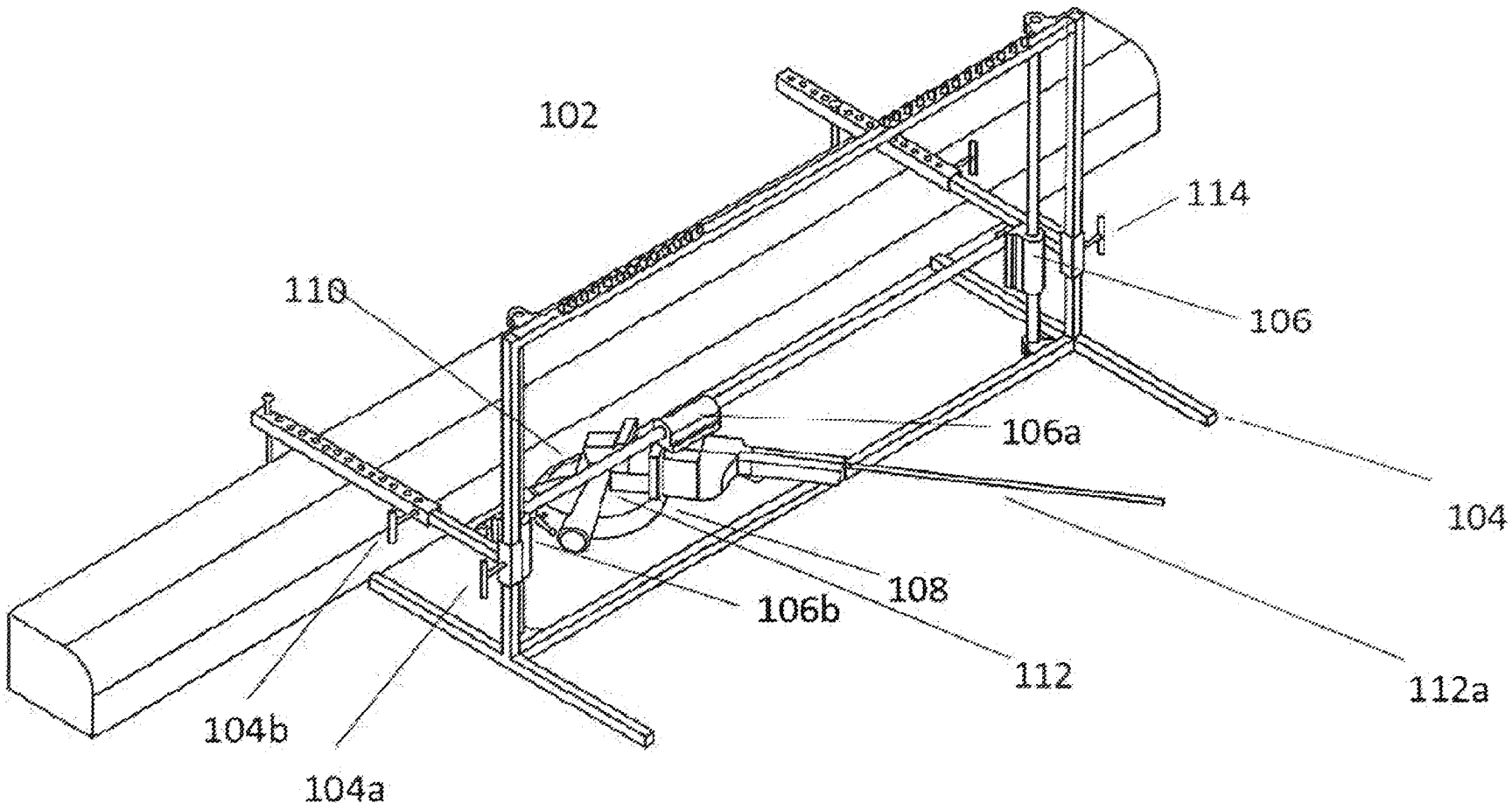
104
112a
106
114
106a
112
108
106b
102
110
104a
104b

APPARATUS FOR FORMING SCORES IN A PLURALITY OF CURB SECTIONS OR A MASONRY STRUCTURE

TECHNICAL FIELD

The present invention generally relates to an apparatus for forming a horizontal and a linear score at a predefined depth or adjustable depth in a plurality of curb sections or a similar concrete or masonry structure.

BACKGROUND

Typically, a curb is a shallow fringe part having a vertical segment utilized for isolating a cleared street partition from a yard or walkway. Such curbs are formed in situ or are precast in sections. A precast curb area might be around 1-meter length, 20 to 30 centimeter in height and 8 to 15 cm in width. With a specific end goal to introduce such precast segments, it is important to dig a trench along the edge of the pavement and to install each curb sections in the trench to such an extent that the curb is flush or projects over the pavement. However, the existing apparatus and devices to make a horizontal, and linear scores at a particular depth in the face of a curb or similar vertical concrete or masonry surface are not efficient because the access is limited to off the shelf wet circular saws, or have irregular curves that prevent wet circular saw guides from being effective.

Therefore, there is a need for an efficient and effective apparatus overcome the problems mentioned above and enables a user to form a horizontal and a linear score at a predefined depth or adjustable depth in a plurality of curb sections or a similar concrete or masonry structure.

The disadvantages and limitations of traditional and conventional approaches will become apparent to the person skilled in the art through a comparison of the described system with some aspects of the present disclosure, as put forward in the remainder of the present application and with reference to the drawings.

SUMMARY OF INVENTION

According to embodiments illustrated herein, there is provided an apparatus for forming a horizontal and a linear score at a predefined depth or adjustable depth in a plurality of curb sections or a similar concrete or masonry structure.

The apparatus comprises a frame, a two-axis of linear bearings guides, an angle grinder, one or more cutting blades, and a protective shield. The frame is adaptable to secure in the curb section or a structure through stakes. The stakes are operable to penetrate a ground or slip into a plurality of holes of a horizontal surface or a vertical surface. The frame includes a plurality of first adjustment units and a plurality of second adjustment units. The plurality of first adjustment units allow adjustments for a plurality of heights according to the height of the curb section or the masonry structure. The plurality of second adjustment units allow adjustments for a plurality of depths according to the depth of the curb section or the masonry structure.

The two-axis of linear bearings guides include a horizontal linear bearing guide and a vertical linear bearing guide. The horizontal linear bearing guide attached to at least two linear bearings on the vertical linear bearing guide. The horizontal linear bearing guide rides up and down on the vertical linear bearing guide and restricted by a height adjustment mechanism. The angle grinder hanged on a mount attached to the linear bearing. The angle grinder is affixed to the linear bearing with a rod-end and allows 360-degrees of rotation around a vertical axis with restricted rotation around a horizontal axis. The hanging mount allows a cut flush with the ground that meets a vertical surface. The cutting blades are attached to a head with set spacing between each blade. The protective shield covers the plurality of cutting blades and further attached to a water supply to provide a spray on the plurality of cutting blades. The protective shield utilizes the water supply to decrease the temperature and lubricates the cutting blades during cutting operation. The protective shield also removes cutting debris and reduces airborne particulates.

In an aspect, the height adjustment mechanism is selected from at least one of a cable, a pulley, and an acme screw adjustment unit.

In an aspect, the angle grinder has a dimension range of 4 inches to 9 inches.

In an aspect, the protective shield comprises one or more rollers to control the depth of cut. The depth of cut is adjusted by rotating the protective shield and locking in place by using a controlling mechanism. The depth of the can also adjusted by multiple roller mechanisms affixed to the protective shield similar to a circular saw depth adjustment. The multiple roller mechanisms are attached to the protective shield and comprise a roller on each side.

Accordingly, one advantage of the present invention is that it provides a hanging design which allows a flush cut with the horizontal surface meeting the face of the structure to be scored.

Another advantage of the present invention is that it provides linear bearings guides to allow accurate, and horizontal lines.

Still another advantage of the present invention is that the vertical height adjustment allows for accurate spacing control.

Another advantage of the present invention is that it the plurality of cutting blades increase the efficiency and reduce the job time. Further, the water cuts down the dust and increases the life of the cutting head.

Another advantage of the present invention is that the depth setting allows the uniform preparation of the masonry structure.

Another advantage is the ability to attach the machine to a plurality of vertical and horizontal surfaces, including but not limited to; curbs, retaining walls, walls, and stairs.

The aforementioned features and advantages of the present disclosure may be appreciated by reviewing the following description of the present disclosure, along with the accompanying figures wherein like reference numerals refer to like parts.

BRIEF DESCRIPTION OF DRAWINGS

The appended drawings illustrate the embodiments of the present system and methods of the present disclosure. Any person with ordinary skills in the art will appreciate that the illustrated element boundaries in the drawings represent an example of the boundaries. In an exemplary embodiment, one element may be designed as multiple elements, or multiple elements may be designed as one element. In an exemplary embodiment, an element shown as an internal component of one element may be implemented as an external component in another and vice versa. Furthermore, the elements may not be drawn to scale.

Various embodiments will hereinafterbe described in accordance with the accompanying drawings, which have been provided to illustrate, not limit, the scope, wherein similar designations denote similar elements, and in which:

The FIGURE represents a block diagram of the present apparatus for forming a horizontal and a linear at a predefined depth or adjustable depth in a plurality of curb sections or a similar concrete or masonry structure, in accordance with at least one embodiment.

DETAILED DESCRIPTION

The present disclosure is best understood with reference to the detailed drawings and description set forth herein. Various embodiments have been discussed with reference to the drawings. However, the person skilled in the art will readily appreciate that the detailed descriptions provided herein with respect to the drawings are merely for explanatory purposes, as the systems and methods may extend beyond the described embodiments. For instance, the teachings presented and the needs of a particular application may yield multiple alternative and suitable approaches to implement the functionality of any detail described herein. Therefore, any approach may extend beyond certain implementation choices in the following embodiments.

The FIGURE represents a block diagram 100 of the present apparatus 102 for forming a horizontal and a linear score at a predefined depth or adjustable depth in a plurality of curb sections or a similar concrete or masonry structure, in accordance with at least one embodiment. The apparatus 102 comprises a frame 104, a two-axis of linear bearings guides 106, an angle grinder 108, one or more cutting blades 110, and a protective shield 112. The frame 104 is adaptable to secure in the curb section or structure through stakes. The stakes are operable to penetrate the ground.

The frame 104 includes a plurality of first adjustment units 104*a* and a plurality of second adjustment units 104*b*. The plurality of first adjustment units 104*a* allow adjustments for a plurality of heights according to the height of the curb section or the masonry structure. In an embodiment, the height adjustment mechanism is selected from at least one of a cable, a pulley, and a screw adjustment unit (114). The plurality of second adjustment units 104*b* allow adjustments for a plurality of depths according to the depth of the curb section or the masonry structure. Thus, the frame 104 is secured to the curb or step on or behind the horizontal surface using stakes. The first adjustment units 104*a* allow for different heights of masonry or concrete structure. In an embodiment, the frame 104 includes second adjustment units 104*b* to allow for different depths of structure, allowing the operator to mount frame in locations best suited for the masonry structure. In an additional embodiment, the adjustment mechanisms are made from spacers, acme machine screws or other positive locating mechanisms.

The two-axis of linear bearings guides 106 include a horizontal linear bearing guide 106*a* and a vertical linear bearing guide 106*b*. The horizontal linear bearing guide 106*a* attached to at least two linear bearings on the vertical linear bearing guide 106*b*. The horizontal linear bearing guide 106*a* rides up and down on the vertical linear bearing guide 106*b* and restricted by a height adjustment mechanism. The angle grinder 108 has hanged on a mount attached to the linear bearing. The angle grinder 108 is affixed to the linear bearing with a rod-end and allows 360-degrees of rotation around a vertical axis with restricted rotation (approximately +/−20 degrees) around a horizontal axis. In an embodiment, the angle grinder 108 has a dimension range of 7 inches to 9 inches. However, larger or smaller angle grinders 108 could be used with a similar tool.

The hanging mount allows a cut flush with the ground that meets a vertical surface. The cutting blades 110 are attached to a head with set spacing between each blade. The protective shield 112 covers the plurality of cutting blades 110 and further attached to a water supply 112*a* to provide a spray on the plurality of cutting blades 110.

The protective shield 112 utilizes the water supply 112*a* to decrease the temperature and lubricates the cutting blades 110 during the cutting operation. In an embodiment, the protective shield comprises one or more rollers to control the depth of cut, wherein the depth of cut is adjusted by rotating the protective shield and locking in place by using a controlling mechanism. The protective shield 112 also removes cutting debris and reduces airborne particulates.

In operation, the present apparatus 102 is attached to a concrete structure, butting the bottom support legs up against the bottom of a vertical surface and using the adjustable units/arms to align stake holes with softer ground or holes drilled in the top of the concrete surface that will accept the stakes. The stakes are then placed in the ground, concrete or hooked behind the curb to secure the machine. The screws on the adjusting arms are tightened down to secure the machine.

The present apparatus 102 is secured to a water supply 112, and a power source is attached. Then the vertical adjustment is set, and the cutting blades 110 are brought to the surface that is to be scored, and depth wheel is adjusted to reflect the wanted depth. Further, the depth is set, the present apparatus 102 is turned on, and scoring begins. The operator rotates the angle grinder 108, drives the spinning saw blades into the vertical surface. Once the depth is reached, the saw is moved horizontally, guided by the horizontal linear bearing guide 106*a*. Once the proper cut length is reached, the present apparatus 102 is turned off, vertical height adjustment made, and operator commences to scoring the surface until the full width and height of the required scoring are completed.

As soon as the scoring is completed, the scored media is removed using a chisel, demolition hammer, or another device. After some slight grinding, a uniform surface is left, allowing the tiles or other things to be inlayed into the vertical surface flush with the remaining structure's surface.

Thus, the present apparatus 100 is designed to make horizontal, and linear scores at a particular depth in the face of a curb section or a similar vertical concrete or masonry surface where access is limited to off the shelf wet circular saws or have irregular curves which prevent the wet circular saw guides from being effective. Further, the present apparatus 100 can not only create a precision recess in a street curb or concrete stair to inlay tile but also be utilized to prepare the curb for tile installation. Furthermore, the hanging design provided by the present apparatus 102 allows flush cut with the horizontal surface meeting the face of the structure to be scored. Additionally, the linear guides allow accurate and horizontal lines and the water cuts down the dust and increases the life of the cutting head.

While embodiments of the present invention have been illustrated and described, it will be clear that the present invention is not limited to these embodiments only. Numerous modifications, changes, variations, substitutions, and equivalents will be apparent to the person skilled in the art, without departing from the spirit and scope of the invention, as described in the claims.

The invention claimed is:

1. An apparatus for forming a horizontal and a linear score at a predefined depth or an adjustable depth in a plurality of curb sections or a similar concrete or masonry structure, the apparatus comprises:

a frame adaptably secured to one of the plurality of the curb sections or the similar concrete or masonry structure through stakes or bolted attachment operable to penetrate the ground, wherein the frame comprises a plurality of first adjustment units to allow adjustments for a plurality of heights of the one of the plurality of the curb sections or the similar concrete or masonry structure, a plurality of second adjustment units to allow adjustments for a plurality of depths of the one of the plurality of the curb sections or the similar concrete or masonry structure, a two-axis of linear bearings guides further comprising a horizontal linear bearing guide and a vertical linear bearing guide, wherein the horizontal linear bearing guide is attached to at least two of the linear bearings on the vertical linear bearing guide, wherein the horizontal linear bearing guide rides up and down on the vertical linear bearing guide and restricted by a height adjustment mechanism, an angle grinder hung on a mount attached to the horizontal linear bearing guide, wherein the angle grinder is affixed to the horizontal linear bearing guide with a rod-end and allows 360-degrees of rotation around a vertical axis with restricted rotation around a horizontal axis, wherein the mount allows a cut perpendicular to the one of the plurality of the curb sections or the similar concrete or masonry structure;

one or more cutting blades to be attached to a head with set spacing between each of the one or more cutting blades; and a protective shield to cover the one or more cutting blades, and a water supply to provide a spray on the one or more cutting blades, wherein the protective shield utilizes the water supply to decrease the temperature and lubricates the one or more cutting blades during operation of the apparatus.

2. The apparatus according to claim 1, wherein the height adjustment mechanism is selected from at least one of a cable, a pulley and a screw adjustment unit.

3. The apparatus according to claim 1, wherein the one or more cutting blades has a dimension range of 4 inches to 9 inches.

4. The apparatus according to claim 1, wherein the protective shield comprises one or more rollers to control the predefined depth or the adjustable depth, wherein the predefined depth or the adjustable depth is adjusted by rotating the protective shield and locking in place by using a controlling mechanism.

* * * * *